US009249950B2

(12) United States Patent
Yin

(10) Patent No.: US 9,249,950 B2
(45) Date of Patent: Feb. 2, 2016

(54) ILLUMINATION DEVICE FOR PROVIDING THE MAXIMUM ILLUMINATION EFFECT

(71) Applicant: JENN FENG NEW ENERGY CO., LTD., Taoyuan County (TW)

(72) Inventor: Wei Kung Yin, Taoyuan County (TW)

(73) Assignee: JENN FENG NEW ENERGY CO., LTD., Taoyuan County (TW)

( * ) Notice: Subject to any disclaimer, the term of this patent is extended or adjusted under 35 U.S.C. 154(b) by 91 days.

(21) Appl. No.: 14/200,252

(22) Filed: Mar. 7, 2014

(65) Prior Publication Data

US 2015/0062917 A1 Mar. 5, 2015

(30) Foreign Application Priority Data

Sep. 4, 2013 (TW) ..... 102216632 U
Jan. 16, 2014 (TW) ..... 103200952 U

(51) Int. Cl.
*F21V 13/04* (2006.01)
*F21V 5/04* (2006.01)
*F21Y 101/02* (2006.01)

(52) U.S. Cl.
CPC ..... *F21V 13/04* (2013.01); *F21V 5/045* (2013.01); *F21Y 2101/02* (2013.01)

(58) Field of Classification Search
CPC ..... F21V 13/04; F21V 5/045; F21V 13/02; F21V 13/00; F21V 5/008; F21V 17/00
See application file for complete search history.

(56) References Cited

U.S. PATENT DOCUMENTS

| | | | | |
|---|---|---|---|---|
| 7,473,007 | B1 * | 1/2009 | Wang | F21L 4/027 362/187 |
| 7,567,754 | B2 * | 7/2009 | Kinoshita | G02B 7/08 348/345 |
| 7,570,439 | B2 * | 8/2009 | Bogdan | H04N 5/2257 359/811 |
| 8,746,920 | B2 * | 6/2014 | Chen | F21L 4/027 362/187 |
| 8,864,343 | B2 * | 10/2014 | Inoue | F21V 13/04 362/296.08 |
| 9,022,610 | B2 * | 5/2015 | Mar | F21L 4/027 362/249.02 |
| 2012/0218765 | A1 * | 8/2012 | Inoue | F21V 13/04 362/308 |
| 2013/0027922 | A1 * | 1/2013 | Chen | F21L 4/027 362/187 |

* cited by examiner

*Primary Examiner* — Bao Q Truong
(74) *Attorney, Agent, or Firm* — Lin & Associates Intellectual Property, Inc.

(57) ABSTRACT

An illumination device includes a light reflector; a base member disposed below the light reflector, having an upper surface provided a light emitting unit for emitting a direct light beam that extends directly to an exterior of the reflector and an indirect light beam that extends to the exterior of the reflector only after being reflected from the reflector; an optical lens disposed within the reflector in such a manner so as to be located above, spaced apart from the light emitting unit at a predetermined distance and lied within a traveling path of the direct light beam such that the direct light beam is adapted to pass through the optical lens; and a lens seat mounted securely on the reflector, having a lower surface that faces the base member and that is formed with a plurality of light incident sections located adjacent to one another.

6 Claims, 5 Drawing Sheets

ILLUMINATION DEVICE FOR PROVIDING THE MAXIMUM ILLUMINATION EFFECT

CROSS-REFERENCE TO RELATED APPLICATIONS

This application claims the priority of Taiwanese patent application Nos. 102216632, filed on Sep. 4, 2013, and 103200952, filed on Jan. 16, 2014, which are incorporated herewith by reference.

BACKGROUND OF THE INVENTION

1. Field of the Invention

The present invention relates generally to an illumination device, and more particularly to an illumination device which utilizes an appropriate optical lens, a light emitting unit and a light reflector in such a manner to collect all of the light beams within a predetermined range, thereby providing the maximum illumination effect.

2. The Prior Arts

One problem encountered presently when designing the application of a light emitting diode (LED) device is how to arrange the components in order to achieve extra illumination from the secondary light beam. The optical lens implemented in a conventional illumination device generally provides an illumination range, which is insufficient in brightness so as to cause blur vision on the illuminated spot. Insufficiency of brightness may result in discomfort to a viewing person and finally leads to visual fatigue. The manufacturers of LED devices have noted the presently existing problem and are searching urgently a way to develop an LED device that is capable of providing comfortable visual effect to a viewer in addition to providing the maximum illumination effect.

FIG. 1 illustrates a conventional LED device, which includes a light reflector 1*a*, an LED module 2*a* disposed at the bottom of the reflector 1*a*, and a slab lens 3*a* disposed above the reflector 1*a*. It is noted that the slab lens 3*a* protects the LED module 2*a* from being damaged and does not provide a secondary light beam, all of the light beams is emitted from the LED module 2*a* in a single way and the light beams are not reflected from the reflector 1*a*.

As best shown in FIG. 1, when the emitting light angle from the LED module 2*a* is at 140°, only the light beams from 20°~48.59° and 131.4°~160° are reflected from the reflector 1*a*. Note that only the above-mentioned light beams within the above-stated degrees are controllable. The remaining light beams are out of bound of the reflection range and hence the reflector 1*a* fails to collect all the light beams into a predetermined range, thereby providing insufficient illumination effect.

FIG. 2 illustrates another conventional LED device, which includes a secondary optical lens unit 4*a* disposed above an LED module 2*a*. The middle of the secondary optical lens unit 4*a* is in the form of a convex lens 41*a*, which has two outwardly curved sides serve as reflection structure for emitting a small emitting angle owing to the refraction performance of the convex lens 41*a*. In other words, the convex lens 41*a* is capable of converting the initial small emitting angle of the LED module 2*a c* into a smaller emitting angle owing to the refraction (or the secondary optical effect), thereby collecting the light beams at the middle portion. Note that the light beams at two sides of the LED module 2*a* are not enhanced by the refraction performance or the secondary optical effect but rather scatter away from the middle, thus the target spot may suffer non-uniform illumination density.

The non-uniform illumination density may result in discomfort to a viewing person and finally leads to visual fatigue. Therefore, a critical problem to be solved urgently is how to improve the collection of all the scattered emitted light beams into a predetermined range so as to provide the maximum illumination with uniform density.

SUMMARY OF THE INVENTION

A primary objective of the present invention is to provide an illumination device, which utilizes an appropriate optical lens, a light emitting unit and a light reflector in such a manner to collect all of the light beams within a predetermined range, thereby providing the maximum illumination effect.

Another objective of the present invention is to provide an illumination device, which includes a light reflector, a base member disposed below the light reflector, and having an upper surface provided with a light emitting unit for emitting a direct light beam that extends directly to an exterior of the light reflector and an indirect light beam that extends to the exterior of the light reflector only after being reflected from the light reflector.

An optical lens is disposed within the light reflector in such a manner so as to be located above, spaced apart from the light emitting unit at a predetermined distance and lied within a traveling path of the direct light beam such that the direct light beam is adapted to pass through the optical lens.

In addition, the illumination device of the present invention further includes a lens seat mounted securely on the light reflector, has a lower surface that faces the base member and that is formed with a plurality of light incident sections located adjacent to one another.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

Figure 1:
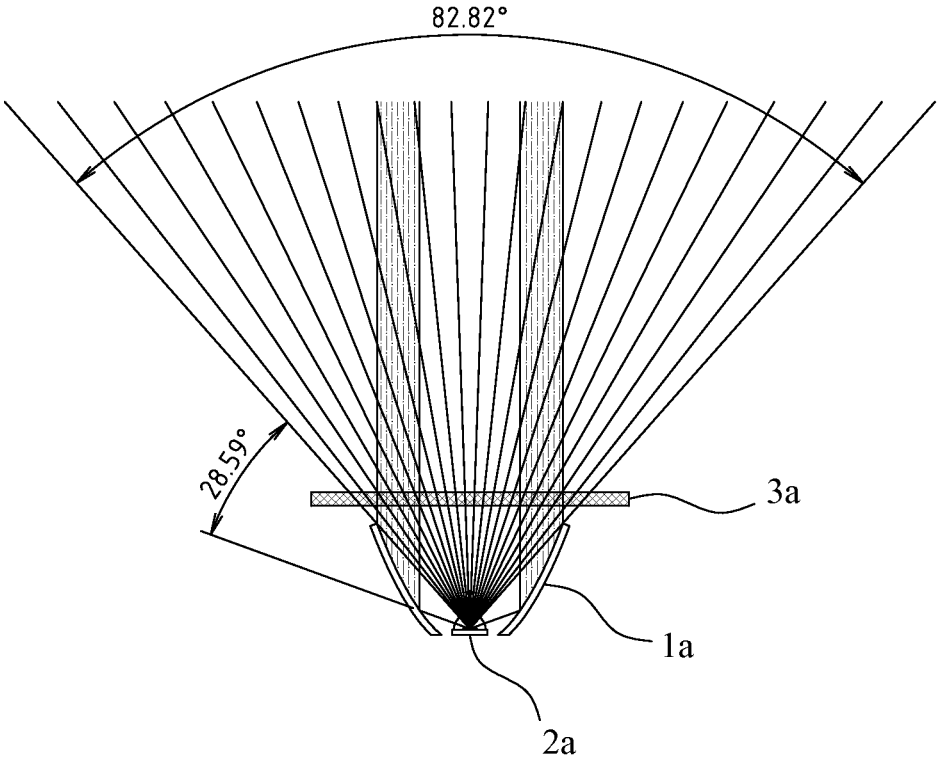
FIG. 1 (PRIOR ART)
FIG. 1 illustrates a conventional LED device.
Figure 2:
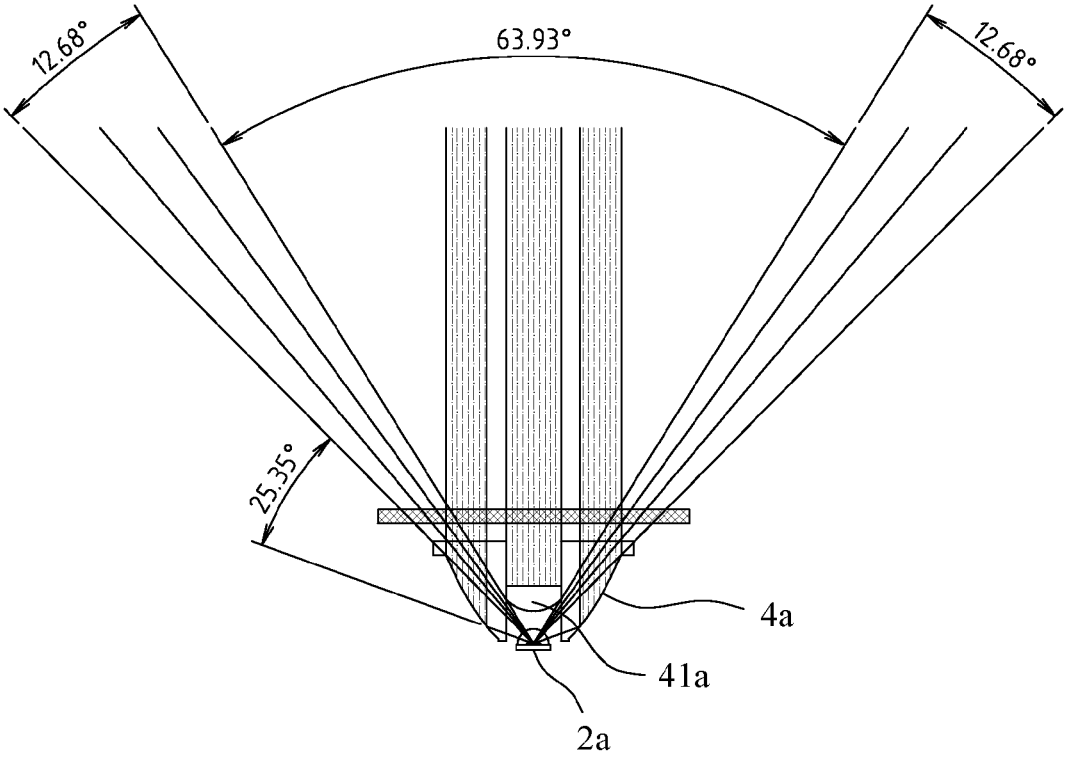
FIG. 2 (PRIOR ART)
FIG. 2 illustrates another conventional LED device.
Figure 3:
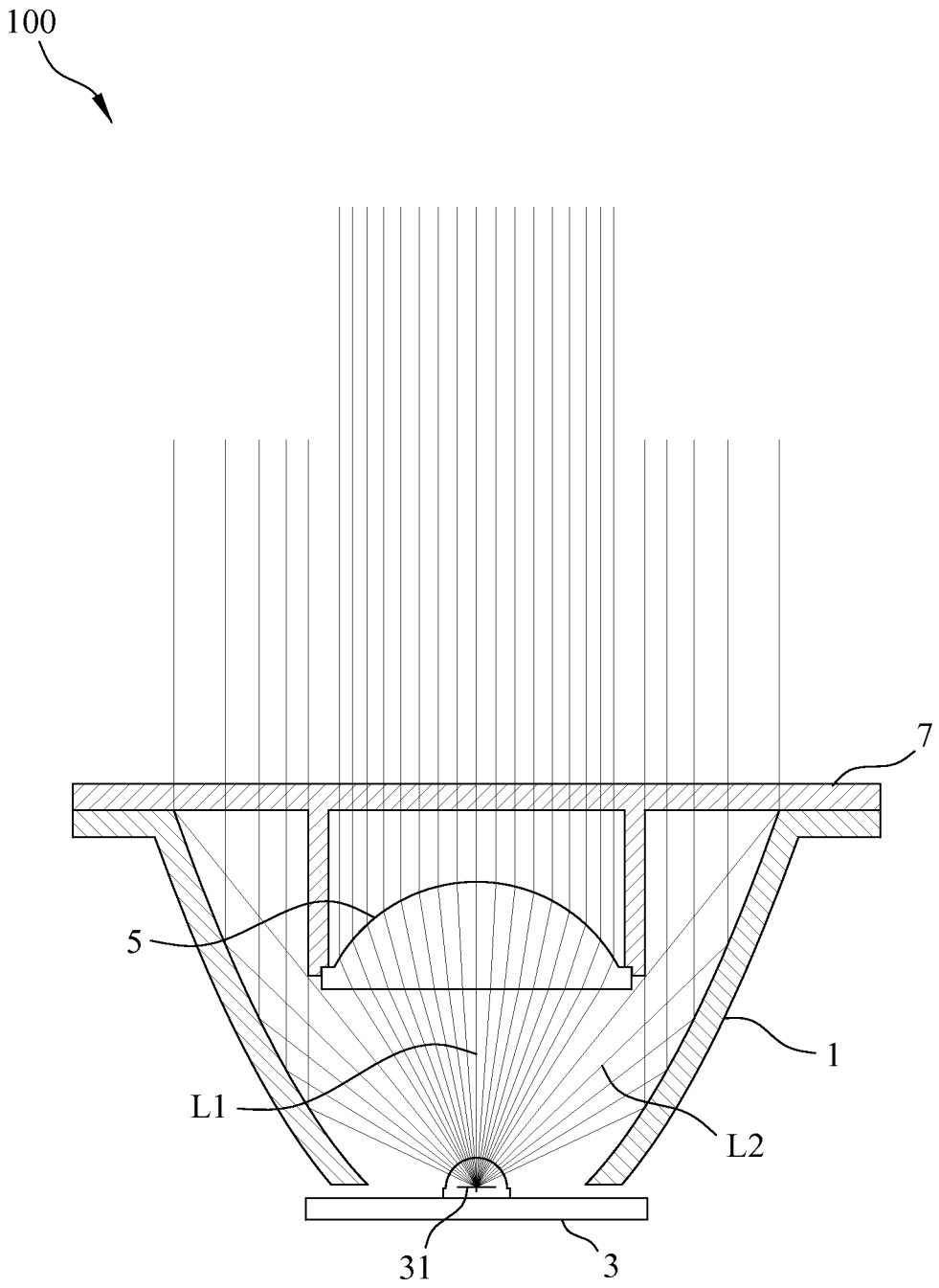
FIG. 3 is a cross-sectional view of the first embodiment of an illumination device of the present invention.
Figure 4:
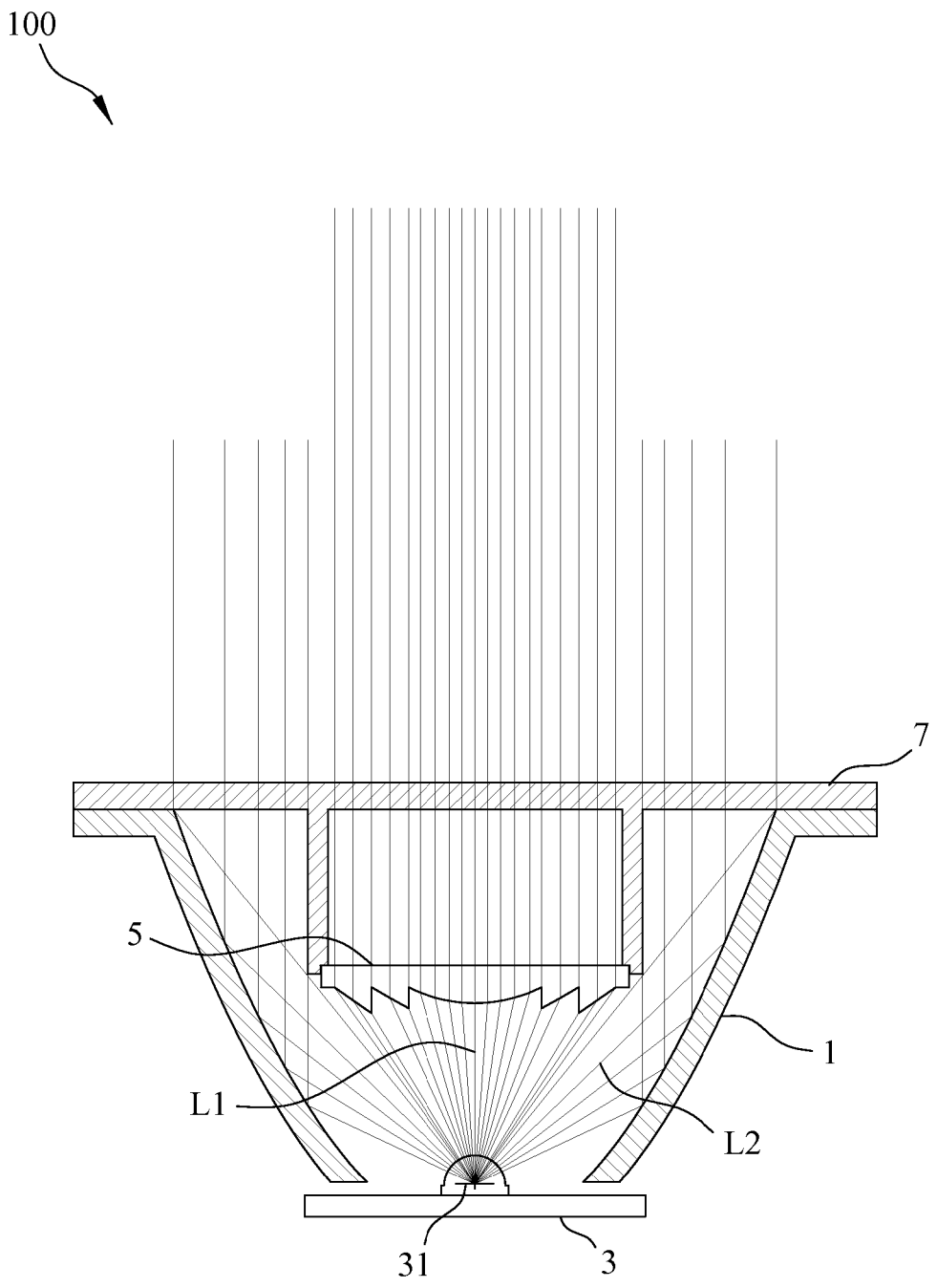
FIG. 4 is a cross-sectional view of the second embodiment of the illumination device of the present invention.

Referring to FIGS. 3 and 4, wherein FIG. 3 is a cross-sectional view of the first embodiment of an illumination device of the present invention for providing the maximum illumination effect and FIG. 4 is a cross-sectional view of the second embodiment of the illumination device of the present invention. As illustrated, the illumination device 100 of the present invention includes a light reflector 1, a base member 3 and an optical lens 5.

The base member 3 is disposed below, at a lower open end of the light reflector 1, has an upper surface provided with a light emitting unit 31 for emitting a direct light beam L1 that extends directly to an exterior of the light reflector 1 and an indirect light beam L2 that extend to the exterior of the light reflector 1 only after being reflected from the light reflector 1. Preferably, in this embodiment, a light emitting diode (LED) unit serves as the light emitting unit 31.

As shown in FIG. 3, the light emitting unit 31 emits two sets of indirect light beam L2 that extend to the exterior of the light reflector 1 only after being reflected from the light reflector 1.

The optical lens 5 is disposed within the light reflector 1 in such a manner so as to be located above, spaced apart from the light emitting unit 31 at a predetermined distance D such that the optical lens 5 is located within a traveling path of the direct light beam L1 such that the direct light beam L1 is adapted to pass through the optical lens 5. Preferably, the optical lens is either a convex lens (see FIG. 3) or a Fresnel lens (see FIG. 4).

As shown in FIG. 3, the illumination device 100 of the present invention further includes a lens seat 7 consisting of an elongated lens base 71 having two ends disposed on the light reflector 1, and a hollow cylindrical portion 73 which extends downwardly from the lens base 71 towards the light emitting unit 31 and within which the optical lens 5 is mounted securely thereto. It is to note that the configuration of the lens seat 7 should not be limited only to the above structure, but should include any configurations so long as it can hold or receive the optical lens 5 therein.

Preferably, in this embodiment, a translucent plate serves as the elongated lens base 71 so as to permit extension of the direct light beam L1 and the indirect light beam L2 after being reflected from the reflector 1.

One distinct feature of the present invention resides in that since an entire of the direct light beam L1 can pass through the optical lens 5, there is no problem of light loss or light collection as encountered in the prior art technique and hence the illumination device 100 of the present invention provides the maximum illumination effect. In addition, owing to the secondary optical effect of the optical lens 5, all the light beams L1, L2 extend frontward so as to provide the maximum illumination effect or range.

Figure 5:
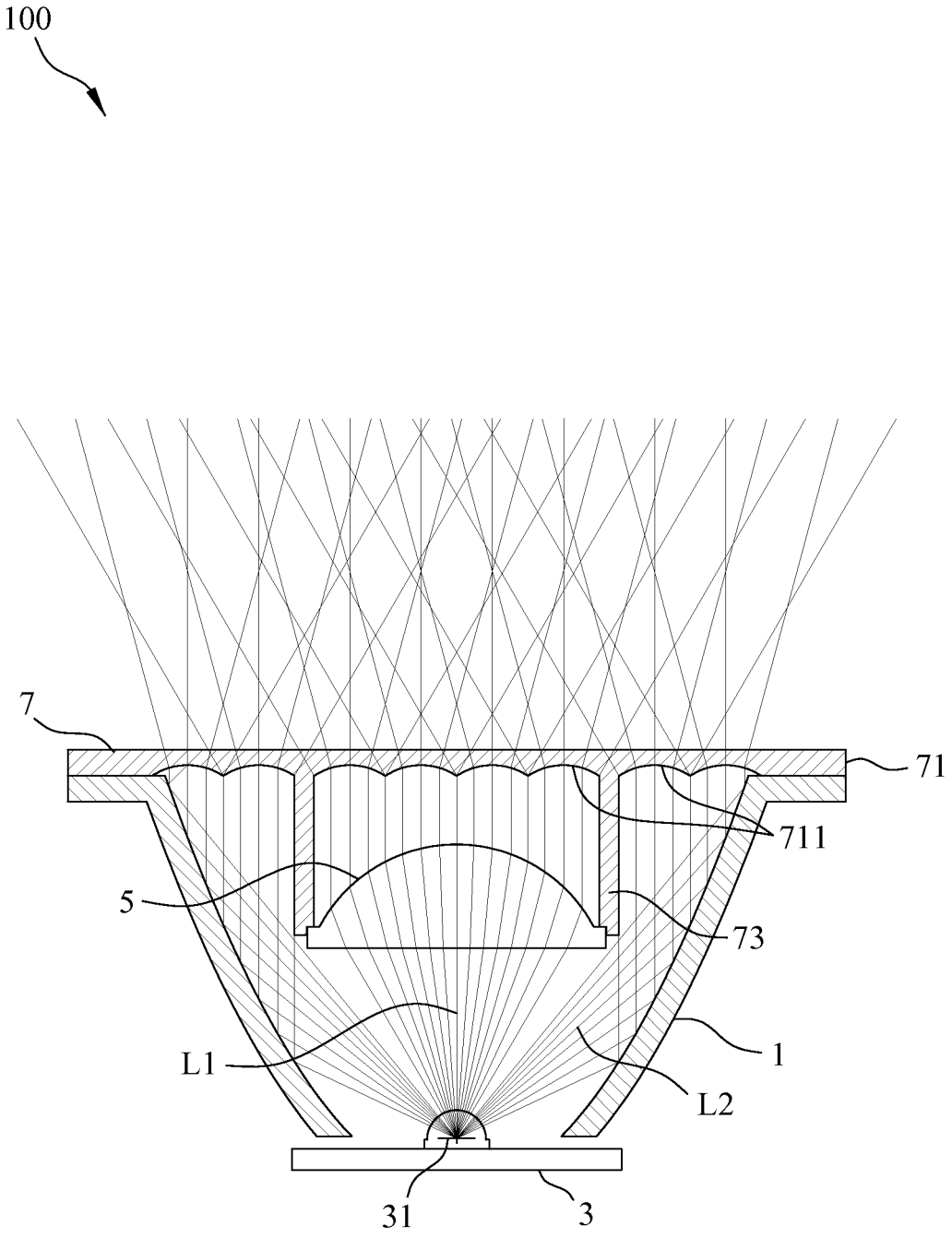
FIG. 5 is a cross-sectional view of the third embodiment of the illumination device of the present invention.

FIG. 5 is a cross-sectional view of the third embodiment of the illumination device of the present invention. The third embodiment has the structure similar to the previous ones, except in that the elongated base 71 has a lower surface that faces the base member 3 and that is formed with a plurality of light incident sections 711 located adjacent to one another. Preferably, each of the plurality of light incident curved sections 711 is curved inwardly or protruded outwardly with respect to the lower surface of the elongated base 71. As best shown in FIG. 5, once the direct light beam L1 and the indirect light beam L2 hit the incident sections 711, the light beams L1, L2 scatter outward owing to configurations of the incident sections 711, thereby providing a larger illumination angle and the maximum illumination effect. Note that, the configuration of the incident sections 711 should not be limited only to the above structures but should any other configuration so long as they provide a large illumination angle.

By providing flexible design relative to convex and concave configurations of the incident sections 711, the maximum illumination effect can be achieved in addition to the large illumination angle.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An illumination device comprising:

a light reflector;

a base member disposed below said light reflector, having an upper surface provided with a light emitting unit for emitting a direct light beam that extends directly to an exterior of said light reflector and an indirect light beam that extends to said exterior of said light reflector only after being reflected from said light reflector;

an optical lens disposed within said light reflector in such a manner so as to be located above, spaced apart from said light emitting unit at a predetermined distance and lied within a traveling path of said direct light beam such that said direct light beam is adapted to pass through said optical lens; and a lens seat mounted securely on said light reflector, having a lower surface that faces said base member and that is formed with a plurality of light incident sections located adjacent to one another;

wherein said lens seat includes an elongated lens base having two ends disposed on said light reflector, and a hollow cylindrical portion which extends downwardly from said lens base towards said light emitting unit and within which said optical lens is mounted securely thereto.

2. The illumination device according to claim 1, wherein a light emitting diode (LED) unit serves as said light emitting unit.

3. The illumination device according to claim 1, wherein a translucent plate serves as said elongated lens base.

4. The illumination device according to claim 1, wherein said optical lens is a Fresnel lens.

5. The illumination device according to claim 1, wherein each of said plurality of light incident sections is curved inwardly or protruded outwardly with respect to said lower surface of said lens seat.

6. The illumination device according to claim 1, wherein said optical lens is a convex lens.

* * * * *